US010844306B2

(12) United States Patent
Mori et al.

(10) Patent No.: US 10,844,306 B2
(45) Date of Patent: Nov. 24, 2020

(54) LUBRICATING OIL COMPOSITION

(71) Applicant: ExxonMobil Research and Engineering Company, Annandale, NJ (US)

(72) Inventors: Takafumi Mori, Kawasaki (JP); Takehisa Sato, Kawasaki (JP); Takahiro Fukumizu, Toyota (JP); Masashi Ogawa, Toyota (JP); Junichi Nishinosono, Toyota (JP)

(73) Assignee: ExxonMobil Research and Engineering Company, Annandale, NJ (US)

( * ) Notice: Subject to any disclaimer, the term of this patent is extended or adjusted under 35 U.S.C. 154(b) by 91 days.

(21) Appl. No.: 16/071,735

(22) PCT Filed: Jan. 23, 2017

(86) PCT No.: PCT/JP2017/002189
§ 371 (c)(1),
(2) Date: Jul. 20, 2018

(87) PCT Pub. No.: WO2017/126706
PCT Pub. Date: Jul. 27, 2017

(65) Prior Publication Data

US 2019/0031973 A1 Jan. 31, 2019

(30) Foreign Application Priority Data

Jan. 21, 2016 (JP) ..... 2016-009467
Dec. 20, 2016 (JP) ..... 2016-246203

(51) Int. Cl.

| | |
|---|---|
| ***C10M 141/06*** | (2006.01) |
| ***C10M 133/56*** | (2006.01) |
| ***C10N 20/02*** | (2006.01) |
| ***C10N 30/02*** | (2006.01) |
| ***C10N 30/06*** | (2006.01) |
| ***C10N 30/00*** | (2006.01) |
| ***C10N 40/04*** | (2006.01) |

(52) U.S. Cl.
CPC ..... *C10M 141/06* (2013.01); *C10M 133/56* (2013.01); *C10M 2203/1025* (2013.01); *C10M 2205/0225* (2013.01); *C10M 2205/0285* (2013.01); *C10M 2207/262* (2013.01); *C10M 2209/084* (2013.01); *C10M 2215/28* (2013.01); *C10M 2219/04* (2013.01); *C10M 2219/046* (2013.01); *C10M 2219/102* (2013.01); *C10N 2020/02* (2013.01); *C10N 2030/02* (2013.01); *C10N 2030/06* (2013.01); *C10N 2030/36* (2020.05); *C10N 2030/52* (2020.05); *C10N 2030/68* (2020.05); *C10N 2030/76* (2020.05); *C10N 2040/04* (2013.01); *C10N 2040/042* (2020.05); *C10N 2040/045* (2020.05)

(58) Field of Classification Search
CPC ..... C10M 139/00; C10M 133/56; C10M 141/06; C10M 2203/1025; C10M 2205/0225; C10M 2205/0285; C10M 2207/262; C10M 2209/084; C10M 2219/04; C10M 2219/102; C10M 2215/28; C10N 2020/02; C10N 2030/02; C10N 2030/06; C10N 2030/36; C10N 2030/52; C10N 2030/68; C10N 2030/76; C10N 2040/04; C10N 2040/042; C10N 2040/045
See application file for complete search history.

(56) References Cited

U.S. PATENT DOCUMENTS

| | | | | |
|---|---|---|---|---|
| 4,029,588 | A * | 6/1977 | Koch | B65D 90/22 508/303 |
| 5,089,156 | A | 2/1992 | Chrisope et al. | |
| 5,489,390 | A * | 2/1996 | Sivik | C08F 8/14 208/262.1 |
| 2007/0293406 | A1* | 12/2007 | Henly | C10M 163/00 508/185 |
| 2008/0234153 | A1 | 9/2008 | Matsui | |
| 2009/0275491 | A1 | 11/2009 | Komatsubara et al. | |
| 2014/0045735 | A1 | 2/2014 | Ayame et al. | |
| 2015/0210954 | A1* | 7/2015 | Miyamoto | C10M 169/04 508/192 |
| 2016/0075964 | A1 | 3/2016 | Komatsubara | |
| 2017/0073607 | A1* | 3/2017 | Skinner | C10M 141/06 |
| 2017/0096617 | A1* | 4/2017 | Clarke | C10M 141/06 |
| 2017/0198234 | A1 | 7/2017 | Matsuki et al. | |

FOREIGN PATENT DOCUMENTS

| | | | |
|---|---|---|---|
| JP | H04264198 | A | 9/1992 |
| JP | 2000-355695 | A | 12/2000 |
| JP | 2003-027081 | A | 1/2003 |
| JP | 2005-220199 | A | 8/2005 |
| JP | 2006-056934 | A | 3/2006 |
| JP | 2006-206924 | A | 8/2006 |
| JP | 2007-126541 | A | 5/2007 |
| JP | 2008-231190 | A | 10/2008 |
| JP | 2009-215395 | A | 9/2009 |

(Continued)

*Primary Examiner* — James C Goloboy
(74) *Attorney, Agent, or Firm* — Dinsmore & Shohl LLP

(57) ABSTRACT

Provided is a lubricating oil composition, which has low viscosity but also prolonged anti-shudder life without reduction of intermetallic friction coefficient. The lubricating oil composition is characterized in comprising (A) a lubricating base oil, and (C) (C-1) a borated succinimide compound with a mass average molecular weight of 4,000-7,000 and (C-2) a borated succinimide compound with a mass average molecular weight of greater than 7,000-10,000.

12 Claims, No Drawings

(56) References Cited

FOREIGN PATENT DOCUMENTS

| | | | |
|---|---|---|---|
| JP | 2010-180278 | A | 8/2010 |
| JP | 2014-196396 | A | 10/2014 |
| JP | 2015-147890 | A | 8/2015 |
| WO | 2012/133345 | A1 | 10/2012 |
| WO | 2014/010462 | A1 | 1/2014 |
| WO | 2014/186318 | A1 | 11/2014 |

* cited by examiner

LUBRICATING OIL COMPOSITION

CROSS-REFERENCE TO RELATED APPLICATIONS

The present application is the National Phase entry of International Patent Application No. PCT/JP2017/002189 filed Jan. 23, 2017, which claims priority to Japanese Patent Application No. 2016-009467 filed Jan. 21, 2016 and Japanese Patent Application No. 2016-246203 filed Dec. 21, 2016, the entire contents of which are hereby incorporated by reference into this application.

FIELD

The present disclosure relates to a lubricating oil composition, and particularly to a lubricating oil composition that is suitable to use for automobile transmissions. More particularly, the present disclosure relates to a lubricating oil composition for continuously variable transmissions.

BACKGROUND

Lubricating oil compositions are widely used in the fields of automobiles including internal combustion engines, automatic transmissions, and gear oils. In recent years, there has been a desire to produce a lubricating oil composition having lower viscosity in order to achieve fuel consumption reduction. Additionally, continuously variable transmissions (CTV) have widely been used instead of stepped automatic transmissions, where metal belt-type CVTs are common, in which power is transmitted using a metal belt and pulleys.

One method for improving fuel efficiency of continuously variable transmission type vehicles is to expand operating conditions for a lockup clutch, in which extension of an anti-shudder life of the lockup clutch is required. However, increasing an amount of a friction modifier to extend the anti-shudder life lowers a metal-to-metal friction coefficient between the metal belt and the pulleys, whereby belt grip performance is reduced, leading to decreased torque transmission capability. Thus, there is a trade-off relationship between the anti-shudder performance and the metal-to-metal friction coefficient, and thus there has been a demand for achieving both sufficient torque characteristics and anti-shudder performance at high level. In addition, when the viscosities of lubricating oil compositions for transmissions are lowered, sufficient metal-to-metal friction coefficient cannot be obtained, so that no sufficiently large torque can be generated.

Examples of conventional lubricating oil compositions for continuously variable transmissions are disclosed in Patent Literature 1 to 5. Patent Literature 1 discloses a lubricating oil composition prepared by adding a specific succinimide compound containing no boron and a phosphorus compound, but not adding zinc dialkyl dithiophosphate, and describes that the lubricating oil composition significantly improves a friction coefficient between a metal belt or chain and pullies, can maintain the high friction coefficient for a long period, and does not clog a clutch plate. Patent Literature 2 discloses a lubricating oil composition containing specific amounts of a sulfonate-based detergent, a salicylate-based detergent, and a boron-containing succinimide-based additive in a specific amount ratio, and describes that the lubricating oil composition has sufficient torque transmission capacity and gear shift characteristics and is excellent in anti-shudder performance. Patent Literature 3 discloses a lubricating oil composition containing specific amounts of a boronated alkyl succinimide and/or boronated alkenyl succinimide having a specific weight-average molecular weight and a metallic detergent having a linear alkyl group, and describes that the composition has a high metal-to-metal friction coefficient and is excellent in gear shift characteristics and anti-shudder performance. Patent Literature 4 discloses a lubricating oil composition containing specific amounts of a specific sulfolane derivative, one or more selected from calcium sulfonate and calcium phenate, and specific viscosity index improvers, and describes that the composition has a high metal friction coefficient and has achieved both fuel consumption reduction by low viscosity and component durability. Patent Literature 5 describes that both a high metal-to-metal friction coefficient and anti-shudder properties can be achieved by adding at least four additives: calcium salicylate, a phosphorus anti-wear agent, a friction modifier, and a dispersion-type viscosity index improver as essential components.

CITATIONS LIST

Patent Literature

Patent Literature 1: Japanese Unexamined Patent Publication (Kokai) No. 2006-056934

Patent Literature 2: Japanese Unexamined Patent Publication (Kokai) No. 2007-126541

Patent Literature 3: Japanese Unexamined Patent Publication (Kokai) No. 2009-215395

Patent Literature 4: Japanese Unexamined Patent Publication (Kokai) No. 2010-180278

Patent Literature 5: Japanese Unexamined Patent Publication (Kokai) No. 2000-355695

SUMMARY

Technical Problem

In view of the above-described problems, it is a first object of the present disclosure to provide a lubricating oil composition that has a prolonged anti-shudder life without lowering metal-to-metal friction coefficient even when the viscosity of the composition is lowered.

Solution to Problem

The present inventors have conducted intensive and extensive studies, and have consequently found that by combining two kinds of boronated succinimide compounds having specific weight-average molecular weights as an ashless dispersant, the anti-shudder life of the lubricating oil composition can be prolonged without lowering metal-to-metal friction coefficient even when the viscosity of the composition is lowered, thereby having completed the present disclosure.

Specifically, the present disclosure provides a lubricating oil composition, comprising:

(A) a lubricating base oil; and (C) (C-1) a boronated succinimide compound having a weight-average molecular weight of 4,000 to 7,000 and (C-2) a boronated succinimide compound having a weight-average molecular weight of more than 7,000 and not more than 10,000.

In addition, improvement in fuel efficiency requires lowering of viscosity at low temperature (for example, 40° C.) that affects fuel consumption while maintaining viscosity at high temperature (for example, 100° C.) as much as possible, i.e., requires high viscosity index. However, the conventional lubricating oil compositions for continuously variable transmissions have a problem where polymer chains of the base oil and the viscosity index improvers are cut by mechanical shearing, and thereby high-temperature viscosity is lowered when traveling.

The present inventors have found that, in the above lubricating oil composition, by additionally specifying the structures of the lubricating base oil and a viscosity index improver, shear stability can be improved, in addition to the effect of prolonging the anti-shudder life without lowering metal-to-metal friction coefficient. Specifically, the present disclosure further provides a lubricating oil composition comprising:

(A) a lubricating base oil; and (C) (C-1) a boronated succinimide compound having a weight-average molecular weight of 4,000 to 7,000 and (C-2) a boronated succinimide compound having a weight-average molecular weight of more than 7,000 and not more than 10,000, wherein part or all of component (A) comprises a poly(α-olefin) or α-olefin copolymer having a kinematic viscosity at 100° C. of 6 to 80 $mm^2/s$ in an amount of 5 to 30% by weight based on a total weight of the lubricating oil composition; and wherein the lubricating oil composition further comprises (B) a polymethacrylate having a weight-average molecular weight of 15,000 to 40,000.

Furthermore, in some embodiments of the lubricating oil composition of the present disclosure include at least one of the following features (1) to (7):

(1) each of component (C-1) and component (C-2) contains 0.1 to 3% by weight of boron based on a weight of component (C-1) and component (C-2).

(2) a weight ratio of component (C-2) to component (C-1), i.e., (C-2)/(C-1) is 1 to 10.

(3) the lubricating oil composition has a kinematic viscosity at 100° C. of 3 to 10 $mm^2/s$.

(4) the lubricating oil composition has a viscosity index of 150 or more.

(5) the lubricating oil composition further comprises (D) a metal detergent.

(6) the lubricating oil composition further comprises (E) an ether sulfolane compound.

(7) the lubricating oil composition is a lubricating oil composition for continuously variable transmissions.

In some other embodiments, the above lubricating oil composition comprises, as part or all of component (A), a poly(α-olefin) or α-olefin copolymer having a kinematic viscosity at 100° C. of 6 to 80 $mm^2/s$ in an amount of 5 to 30% by weight based on a total weight of the lubricating oil composition, and comprises (E) an ether sulfolane compound. Synthetic base oil has lower affinity to oil sealing rubber called packing or gasket than mineral oil, and the higher molecular weight (higher viscosity) the base oil has, the lower the affinity thereof is. When the base oil has low affinity to sealing rubber, swellability of the sealing rubber is reduced, and conversely the rubber tends to shrink. This causes a problem where sealability is reduced and thereby oil leakage occurs. The lubricating oil composition of the present disclosure having the above structure can further ensure the swellability of sealing rubber.

Effects of Present Disclosure

The lubricating oil composition of the present disclosure can have a prolonged anti-shudder life without lowering metal-to-metal friction coefficient. The effect can be achieved even when the kinematic viscosity at 100° C. of the lubricating oil composition is lowered to about 5.0. Additionally, the present disclosure can provide a lubricating oil composition that furthermore has an improved shear stability, in addition to the above effect. Still furthermore, the swellability of sealing rubber can also be ensured. The lubricating oil composition of the present disclosure can be particularly suitably used as a lubricating oil composition for continuously variable transmissions.

DESCRIPTION OF EMBODIMENTS

The respective components will be described hereinbelow.

(A) Lubricating Base Oil

As the lubricating base oil in the present disclosure, a conventionally known lubricating base oil can be used, such as a mineral oil, synthetic oil, or a mixed oil thereof. In some embodiments, part or all of the lubricating base oil comprises a poly(α-olefin) or α-olefin copolymer having a kinematic viscosity at 100° C. of 6 to 80 $mm^2/s$ in an amount of 5 to 30% by weight based on the total weight of the lubricating oil composition, in which the lower limit is 6% by weight, or 8% by weight, and the upper limit is 25% by weight, or 20% by weight. When the content of the base oil is less than the above lower limit value, there cannot be obtained any sufficient viscosity index, i.e., both fuel consumption reduction and mechanical element protection performance, and when the content thereof is more than the above upper limit value, shear stability reduction and rubber compatibility deterioration (rubber shrinkage) can occur.

The poly(α-olefin) or α-olefin copolymer has a kinematic viscosity at 100° C. of 6 to 80 $mm^2/s$, 8 to 80 $mm^2/s$, 8 to 60 $mm^2/s$, or 9 to 40 $mm^2/s$ at 100° C. When the kinematic viscosity at 100° C. is less than the above lower limit value, there cannot be obtained viscosity index, i.e., both fuel consumption reduction and mechanical element protection performance, and when the kinematic viscosity at 100° C. is more than the above upper limit value, shear stability and of rubber compatibility are deteriorated (rubber shrinkage). Thus, both cases are not preferable.

The poly(α-olefin) or α-olefin copolymer can be any (co)polymer or (co)oligomer of α-olefin having the above-mentioned kinematic viscosity, and a conventionally known one can be used as the lubricating base oil. The α-olefin is selected from, for example, linear or branched olefin hydrocarbons having 2 to 14 carbon atoms, or 4 to 12 carbon atoms, and examples thereof include 1-octene oligomer, 1-decene oligomer, ethylene-propylene oligomer, isobutene oligomer, and hydrogenated products thereof. Additionally, the poly(α-olefin) or α-olefin copolymer may be one manufactured using a metallocene catalyst. The weight-average molecular weight of the (co)polymer or (co)oligomer can be any as long as the kinematic viscosity at 100° C. satisfies the above range. For example, the weight-average molecular weight thereof is 1,000 to 10,000, or 1,100 to 7,000. The poly(α-olefin) or α-olefin copolymer may be used singly or in combination of two or more types thereof.

The lubricating oil composition of the present disclosure may include other lubricating base oils in combination with the above poly(α-olefin) or α-olefin copolymer. These lubricating base oils are not particularly limited, and any of conventionally known mineral oil-based base oils and synthetic base oils other than the above poly(α-olefin) or α-olefin copolymer can be used.

Examples of the mineral oil-based base oils include paraffin-based or naphthene-based lubricating base oils obtained by distilling crude oil at atmospheric pressure and under reduced pressure to produce a lubricating oil fraction and refining the lubricating oil fraction through appropriate combinations of refining treatments such as solvent deasphalting, solvent extraction, hydrocracking, solvent dewaxing, catalytic dewaxing, hydrorefining, washing with sulfuric acid, and clay treatment; and lubricating base oils obtained by isomerization and dewaxing of a wax obtained by solvent dewaxing. The kinematic viscosity of the mineral oil-based base oils is, but not limited to, 1 to 5 $mm^2/s$ in order to obtain a lubricating oil composition having low viscosity.

Examples of the synthetic base oils that can be used include isoparaffin, alkyl benzene, alkyl naphthalene, monoester, diester, polyol ester, polyoxyalkylene glycol, dialkyl diphenyl ether, polyphenyl ether, and GTL base oils. The kinematic viscosity of the synthetic base oils is not particularly limited. Additionally, it is also possible to use a poly(α-olefin) or α-olefin copolymer having a kinematic viscosity at 100° C. of less than 6 $mm^2/s$ or more than 80 $mm^2/s$. In some embodiments, in order to obtain a lubricating oil composition having low viscosity, the kinematic viscosity of the synthetic base oils is 1 to 6 $mm^2/s$.

The base oils that can be used in combination may be used singly or in combination of two or more types thereof. When using in combination of two or more types, it is possible to use two or more mineral oil-based base oils, to use two or more synthetic base oils, and to use one or more mineral oil-based base oils and one or more synthetic base oils. In some embodiments, it is suitable to use a mineral oil-based base oil singly, to use two or more mineral oil-based base oils, to use a synthetic base oil having a kinematic viscosity at 100° C. of not less than 1 and less than 6 $mm^2/s$ singly, and to use two or more synthetic base oils having a kinematic viscosity at 100° C. of not less than 1 and less than 6 $mm^2/s$.

In addition, in order to obtain a lubricating oil composition having low viscosity, it is useful to have, as the entire lubricating base oil, a kinematic viscosity at 100° C. of 2 to 7 $mm^2/s$, 2.3 to 6 $mm^2/s$, or 2.5 to 5.6 $mm^2/s$.

(B) Viscosity Index Improver

The lubricating oil composition of the present disclosure can include a conventionally known viscosity index improver. In some embodiments, the lubricating oil composition includes a polymethacrylate having a weight-average molecular weight of 15,000 to 40,000 as the viscosity index improver. The lower limit of the weight-average molecular weight is 17,000, or 18,000. The upper limit of the weight-average molecular weight is 38,000, or 36,000. When the weight-average molecular weight is less than the above lower limit value, the effect of improving the viscosity index is insufficient, and when the weight-average molecular weight is more than the above upper limit value, the effect of improving the viscosity index can be obtained whereas shear stability is deteriorated. Thus, both cases are not preferable. The content of the polymethacrylate in the lubricating oil composition is, but not limited to, 0.1 to 20% by weight, 1 to 15% by weight, or 2 to 10% by weight.

The polymethacrylate may be used singly or in combination of two or more types. When used in combination of two or more types, the contents of the polymethacrylates are not limited. However, the total content of the polymethacrylates in the lubricating oil composition is 0.1 to 20% by weight, 1 to 15% by weight, or 2 to 10% by weight.

The lubricating oil composition of the present disclosure may include comprise other viscosity index improvers in combination with the above-described polymethacrylate(s). Examples of the other viscosity index improvers include polymethacrylates having a weight-average molecular weight of less than 15,000, polymethacrylates having a weight-average molecular weight of more than 40,000, polyisobutylene and hydrogenated products thereof, hydrogenated styrene-diene copolymers, styrene-maleic anhydride ester copolymers, and polyalkylstyrene. When the lubricating oil composition comprises other viscosity index improver(s), the amount thereof in the lubricating oil composition is, in some embodiments, 0.1 to 15% by weight.

(C) Boronated Succinimide Compound

The lubricating oil composition of the present disclosure is characterized in that the composition comprises two types of specific boronated succinimide compounds as an ashless dispersant. Specifically, the present disclosure is characterized in that the lubricating oil composition comprises a combination of (C-1) a boronated succinimide compound having a weight-average molecular weight of 4,000 to 7,000, or 5,000 to 7,000 and (C-2) a boronated succinimide compound having a weight-average molecular weight of more than 7,000 and not more than 10,000, or 7,100 to 9,600. Hereinbelow, above component (C-1) may be referred to as first boronated succinimide compound, and above component (C-2) may be referred to as second boronated succinimide compound. The composition comprises component (C) in an amount of 0.5 to 3.0% by weight, 0.6 to 2.5% by weight, or 0.9 to 2.0% by weight, based on the total weight of the composition. When the content thereof is less than the above lower limit, anti-shudder performance cannot be obtained. When the content thereof is more than the above upper limit, low-temperature viscosity can be increased.

The weight ratio of component (C-2) to component (C-1), i.e., (C-2)/(C-1) is, but not limited to, 1 to 10, 1.5 to 8, or 2 to 6. By including the components in a ratio within the above range, both friction coefficient and anti-shudder characteristics can be satisfied.

When the amount of (C-1) is insufficient, there is a problem where regarding anti-shudder properties, characteristics at low temperature, for example, at 40° C. become insufficient, and this will be apparent early in durability testing. When the amount of (C-2) is insufficient, there is a problem where characteristics at high temperature, for example, at 120° C. become insufficient, and this will be apparent early in durability testing.

The first and second boronated succinimide compounds in the present disclosure may be boronated succinimide compounds known as the ashless dispersant. A boronated succinimide compound includes a product obtained by modifying (boronating) a succinimide compound having at least one alkyl group or alkenyl group in a molecule thereof with boric acid, a borate, or the like. Examples of the alkyl group or alkenyl group include oligomers of olefins such as propylene, 1-butene, and isobutylene and co-oligomers of ethylene and propylene.

More particularly, a succinimide compound is a compound obtained by adding succinic anhydride to a polyamine. The succinimide compound includes a mono-type succinimide compound and a bis-type succinimide compound, and either of which can be used. An example of a mono-type succinimide compound can be represented by following formula (1). An example of a bis-type succinimide compound can be represented by following formula (2):

(1)

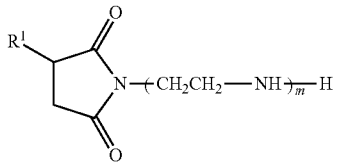

(2)

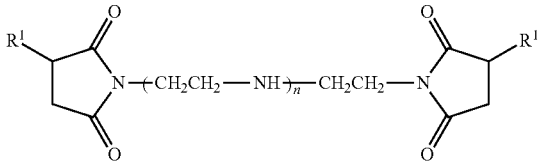

In the above formulae, $R^1$ each independently represents an alkyl group or alkenyl group having 40 to 400 carbon atoms, m is an integer of 1 to 10, and n is an integer of 0 to 10. In some embodiments, a bis-type succinimide compound is used. The boronated succinimide compounds may be a combination of a mono-type and a bis-type, a combination of two or more mono-types, or a combination of two or more bis-types.

More particularly, the boronated succinimide compound is a compound obtained by reacting a succinimide compound represented by formula (1) or (2) with a boron compound. Examples of the boron compound include a boric acid, a boric anhydride, a borate, a boric oxide, and a boron halide.

The first boronated succinimide compound (C-1) has a weight-average molecular weight of 4,000 to 7,000. The weight-average molecular weight is 5,000 to 7,000, or 5,200 to 6,800. When the molecular weight of the first boronated succinimide compound is less than 4,000, anti-shudder characteristics are deteriorated.

Note that, in the present disclosure, the weight-average molecular weight of the first boronated succinimide compound is a weight-average molecular weight measured by an RI (differential refractive index) detector, using a solvent of THF (tetrahydrofuran) and a packed column of styrene-divinylbenzene copolymer at a set temperature of 40° C. and a set flow rate of 1.0 mL/min, and expressed in terms of polystyrene.

The boron content in the first boronated succinimide compound is, but not limited to, 0.1 to 3% by weight, 0.2 to 2.5% by weight, 0.2 to 2% by weight, or 0.2 to 1.5% by weight, based on the weight of the compound. The nitrogen content in the succinimide compound is, but not limited to, 0.3 to 10% by weight, 0.5 to 5% by weight, or 0.8 to 2.5% by weight, based on the weight of the compound.

The content of the first boronated succinimide compound in the lubricating oil composition is, but not limited to, 0.05 to 2.00% by weight, 0.08 to 1.80% by weight, or 0.10 to 1.50% by weight, based on the total weight of the lubricating oil composition. When the content thereof is less than the lower limit value, sufficient detergency may not be able to be obtained, and when the content thereof is more than the upper limit value, sludge can occur.

The second boronated succinimide compound (C-2) has a weight-average molecular weight of more than 7,000 and not more than 10,000. The weight-average molecular weight is 7,100 to 9,600, or 7,500 to 9,200. When the molecular weight of the second boronated succinimide compound is more than 10,000, low-temperature viscosity is deteriorated.

Note that, in the present disclosure, the weight-average molecular weight of the second boronated succinimide compound is a weight-average molecular weight measured by an RI (differential refractive index) detector, using a solvent of THF (tetrahydrofuran) and a packed column of styrene-divinylbenzene copolymer at a set temperature of 40° C. and a set flow rate of 1.0 mL/min, and expressed in terms of polystyrene.

The boron content in the second boronated succinimide compound is, but not limited to, 0.1 to 3% by weight, 0.2 to 2.5% by weight, 0.2 to 2% by weight, or 0.2 to 1.5% by weight, based on the weight of the compound. The nitrogen content in the succinimide compound is, but not limited to, 0.2 to 5.0% by weight, 0.3 to 2.5% by weight, or 0.5 to 2.0% by weight.

The content of the second boronated succinimide compound in the lubricating oil composition is, but not limited to, 0.2 to 3.0% by weight, 0.4 to 2.5% by weight, or 0.6 to 2.0% by weight. When the content thereof is less than the lower limit value, sufficient detergency may not be able to be obtained, and when the content thereof is more than the upper limit value, low-temperature viscosity occurs.

The lubricating oil composition of the present disclosure can further comprise other ashless dispersants in combination with components (C-1) and (C-2). A typical example of another ashless dispersant includes (C-3) a non-boronated succinimide compound.

A non-boronated succinimide compound is a succinimide compound having at least one alkyl group or alkenyl group in a molecule thereof. An example thereof is the succinimide compound represented by formula (1) or (2) above. As the succinimide compound, either a mono-type succinimide compound or a bis-type succinimide compound can be used. In some embodiments, a bis-type succinimide compound is used. The succinimide compound may be a combination of a mono-type and a bis-type, a combination of two or more mono-types, or a combination of two or more bis-types.

When the lubricating oil composition comprises a succinimide compound containing no boron, the content thereof in the lubricating oil composition is 2% by weight or less, or 1% by weight or less.

In some embodiments, the lubricating oil composition of the present disclosure further comprises (D) a metal detergent and/or (E) an ether sulfolane compound, in addition to above components (A) to (C).

(D) Metal Detergent

A metal detergent includes detergents containing an alkali metal or an alkaline earth metal. Examples thereof include, but are not limited to, sulfonates containing an alkali metal or alkaline earth metal, salicylates containing an alkali metal or alkaline earth metal, and phenates containing an alkali metal or alkaline earth metal. The alkali metal or alkaline earth metal include, but are not limited to, magnesium, barium, sodium, and calcium.

In some embodiments, used sulfonates containing an alkali metal or alkaline earth metal include, but are not limited to, calcium sulfonate and magnesium sulfonate.

In some embodiments, used salicylates containing an alkali metal or an alkaline earth metal include, but are not limited to, calcium salicylate and magnesium salicylate.

In some embodiments, used phenates containing an alkali metal or an alkaline earth metal include, but are not limited to, calcium phenate and magnesium phenate.

The amount of the alkali metal or alkaline earth metal contained in the metal detergent is, but not limited to, 0.1 to 20% by weight, 0.5 to 15% by weight, or 1.0 to 15% by weight.

The metal detergent has a total base number of, but not limited to, 10 to 500 mgKOH/g, 50 to 400 mgKOH/g, or 150 to 400 mgKOH/g. Particularly, when the total base number thereof is 200 to 400 mgKOH/g, 300 to 400 mgKOH/g, 310 to 400 mgKOH/g, it is useful since high detergent effect is obtained, and the occurrence of sludge can be suppressed.

The content of the metal detergent in the lubricating oil composition is, but not limited to, 0 to 5% by weight, 0.1 to 2% by weight, or 0.2 to 1% by weight.

The metal detergent may be used singly or in combination of two or more types. When used in combination, the combinations of the metal detergents include, but are not limited to, a combination of two or more sulfonate compounds, a combination of two or more salicylate compounds, a combination of two or more phenate compounds, a combination of at least one sulfonate compound and at least one salicylate compound, a combination of at least one sulfonate compound and at least one phenate compound, and a combination of at least one salicylate compound and at least one phenate compound.

(E) Ether Sulfolane Compound

The lubricating oil composition of the present disclosure may further ensure appropriate sealing rubber swellability by comprising an ether sulfolane compound. The ether sulfolane compound is a compound as follows:

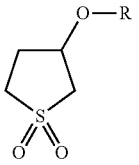

In the above formula, R is an alkyl group having 1 to 20 carbon atoms, or an alkyl group having 8 to 16 carbon atoms.

The content of the ether sulfolane compound in the lubricating oil composition is 0 to 5% by weight, 0.1 to 2% by weight, or 0.2 to 1% by weight.

The lubricating oil composition of the present disclosure may further comprise additives other than above components (B) to (E). Examples of the other additives include oil agents, anti-wear agents, extreme pressure agents, rust inhibitors, friction modifiers, antioxidants, corrosion inhibitors, metal deactivators, pour point depressants, antifoaming agents, colorants, and packaged additives for automatic transmission oil. It is also possible to add various packaged additives for lubricating oil that contain at least one of the above additives.

The kinematic viscosity at 100° C. of the lubricating oil composition of the present disclosure is, but not limited to, 3 to 10 $mm^2/s$, 3 to 8 $mm^2/s$, 4 to 7.5 $mm^2/s$, or 4 to 6 $mm^2/s$. When the kinematic viscosity at 100° C. of the lubricating oil composition is less than the above lower limit value, sufficient friction coefficient may not be able to be obtained. Additionally, when it is more than the above upper limit value, anti-shudder characteristics may be deteriorated.

The viscosity index of the lubricating oil composition of the present disclosure is, but not limited to, 150 or more, or 160 or more. When the viscosity index of the lubricating oil composition is less than the above lower limit value, sufficient low-temperature characteristics may not be able to be obtained. In some embodiments, the upper limit is, but not limited to, 250.

The lubricating oil composition of the present disclosure has a sufficiently large metal-to-metal friction coefficient even at lowered viscosity, and also can effectively obtain anti-shudder characteristics. In addition, as described above, shear stability can also be ensured by additionally specifying the structures of the base oil and the viscosity index improver in accordance with the present disclosure. Furthermore, adding an ether sulfolane compound can ensure appropriate swellability of sealing rubber. In some embodiments, a metal detergent having a total base number of 200 to 400 mgKOH/g is used since the occurrence of sludge can be suppressed while ensuring detergency. The lubricating oil composition of the present disclosure may be suitably used for continuously variable transmissions.

EXAMPLES

Hereinafter, the present disclosure will be described in more detail by illustrating Examples and Comparative Examples. However, the present disclosure is not limited to the following Examples.

Respective components used in Examples and Comparative Examples are listed below. The respective components below were mixed in compositions listed in Table 1 or 2 to prepare lubricating oil compositions. In the following description, KV100 means kinematic viscosity at 100° C., VI means viscosity index, and PMA means polymethacrylate.

(A) Lubricating Base Oil

- Mineral oil 1: highly hydrogenated refined paraffin-based base oil (KV100=3.1 $mm^2/s$, VI=112)
- Mineral oil 2: highly hydrorefined paraffin-based base oil (KV100=4.2 $mm^2/s$, VI=122)
- Mineral oil 3: highly hydrorefined paraffin-based base oil (KV100=4.2 $mm^2/s$, VI=134)
- Mineral oil 4: hydrorefined paraffin-based base oil (KV100=2.2 $mm^2/s$, VI=109)
- Mineral oil 5: hydrorefined paraffin-based base oil (KV100=2.5 $mm^2/s$, VI=99)
- Synthetic base oil 1: poly(α-olefin) (KV100=4.1 $mm^2/s$, VI=126)
- Synthetic base oil 2: poly(α-olefin) (KV100=10 $mm^2/s$, VI=137)
- Synthetic base oil 3: poly(α-olefin) (KV100=40 $mm^2/s$, VI=147)
- Synthetic base oil 4: ethylene-α-olefin copolymer (KV100=10 $mm^2/s$, VI=150)
- Synthetic base oil 5: ethylene-α-olefin copolymer (KV100=40 $mm^2/s$, VI=155)
- Synthetic base oil 6: ethylene-α-olefin copolymer (KV100=100 $mm^2/s$, VI=165)

(B) Viscosity Index Improver

- PMA-based viscosity index improver 1 (Mw=30,000)

(C) Boronated Succinimide Compound (C-1)

- Boronated succinimide compound 1 (Mw=5,600, B: 0.34% by weight, N=1.58% by weight, containing a polyisobutenyl group)
- Boronated succinimide compound 3 (Mw=4,600, B: 1.8% by weight, N=2.35% by weight, containing a polyisobutenyl group)

(C-2)

- Boronated succinimide compound 2 (Mw=8,500, B: 0.23% by weight, N=0.88% by weight, containing a polyisobutenyl group)

(D) Metal Detergent

Ca sulfonate (total base number: 350 mgKOH/g)

Ca salicylate (total base number: 300 mgKOH/g)

Mg salicylate (total base number: 400 mgKOH/g)

(E) Ether Sulfolane Compound

LUBRIZOL 730 (a compound of the following formula, in which $R^1$ is $C_{10}H_{21}$)

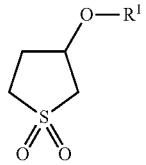

(F) Other Additives

Anti-wear agent, friction modifier, antioxidant, defoaming agent, metal deactivator, and colorant

TABLE 1

| | Composition (% by weight) | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|---|
| (A) | Mineral oil 1 | 70.39 | 70.39 | 83.08 | 83.08 | 70.39 | 70.39 | 70.39 | | | | 70.99 |
| | Mineral oil 2 | | | | | | | | 34.28 | | | |
| | Mineral oil 3 | | | | | | | | | 25.12 | | |
| | Mineral oil 4 | | | | | | | | 36.11 | | | |
| | Mineral oil 5 | | | | | | | | | 45.27 | 71.82 | |
| | Synthetic base oil 1 | | | | | | | | | | | |
| | Synthetic base oil 2 | 20.95 | | | | 20.95 | 20.95 | 20.95 | 20.95 | 20.95 | 20.95 | 20.95 |
| | Synthetic base oil 3 | | | | 8.26 | | | | | | | |
| | Synthetic base oil 4 | | 20.95 | | | | | | | | | |
| | Synthetic base oil 5 | | | 8.26 | | | | | | | | |
| | Kinematic viscosity KV100 of entire base oil | 4.0 | 4.0 | 4.0 | 3.7 | 4.0 | 4.0 | 4.0. | 4.0 | 4.0 | 3.0 | 4.0 |
| (B) | Viscosity index improver 1 | 3.08 | 3.08 | 3.08 | 3.08 | 3.08 | 3.08 | 3.08 | 3.08 | 3.08 | 1.65 | 3.08 |
| (C) | Boronated succinimide compound 2 | 1.49 | 1.49 | 1.49 | 1.49 | 1.49 | 1.49 | 1.49 | 1.49 | 1.49 | 1.49 | 1.49 |
| | Boronated succinimide compound 1 | 0.33 | 0.33 | 0.33 | 0.33 | 0.33 | 0.33 | 0.33 | 0.33 | 0.33 | 0.33 | 0.33 |
| | Boronated succinimide compound 3 | | | | | | | | | | | |
| (D) | Calcium sulfonate | 0.16 | 0.16 | 0.16 | 0.16 | | | | 0.16 | 0.16 | 0.16 | 0.16 |
| | Calcium salicylate | | | | | 0.16 | 0.03 | | | | | |
| | Magnesium salicylate | | | | | | 0.13 | 0.16 | | | | |
| (E) | Ether sulfolane | 0.60. | 0.60 | 0.60 | 0.60 | 0.60 | 0.60 | 0.60 | 0.80 | 0.60 | 0.60 | |
| | Other additives | 3.00 | 3.00 | 3.00 | 3.00 | 3.00 | 3.00 | 3.00 | 3.00 | 3.00 | 3.00 | 3.00 |

TABLE 2

| | Composition (% by weight) | Comp. Ex. 1 |
|---|---|---|
| (A) | Mineral oil 1 | 70.39 |
| | Mineral oil 5 | |
| | Synthetic base oil 1 | |
| | Synthetic base oil 2 | 20.95 |
| | Synthetic base oil 6 | |
| | Kinematic viscosity KV100 of entire base oil | 3.7 |

TABLE 2-continued

| | Composition (% by weight) | Comp. Ex. 1 |
|---|---|---|
| (B) | Viscosity index improver 1 | 3.08 |
| Ashless dispersant | Boronated succinimide compound 2 | |
| | Boronated succinimide compound 1 | 0.33 |
| | Boronated succinimide compound 3 | 1.49 |
| (D) | Calcium sulfonate | 0.16 |
| (E) | Ether sulfolane | 0.60 |
| | Other additives | 3.00 |

Various properties of the respective lubricating oil compositions were measured according to the following methods. Tables 3 and 4 give the results.

(1) Kinematic Viscosity at 100° C. (KV100)

Test method: measured according to ASTM D445.

(2) Viscosity Index

Test method: measured according to ASTM D2270.

(3) Shear Stability

Test method: according to JASO M347-2014, measured a viscosity at 100° C. after 10 hours to determine a rate of change from a viscosity before starting the test.

(4) Anti-Shudder Life

Test method: according to JASO M349-2012, measured a time during which any of values of dμ/dv (average in 1.0 to 2.0 m/s) evaluated at 40° C., 60° C., 80° C., and 120° C. was below $-2\times10^{-3}$.

(5) Friction Coefficient (Comparison with a Commercially Available Product)

Test was performed by an SRV friction and wear testing machine manufactured by Optimol Co. Ltd., using a SUJ ball (diameter: 10 mm) and a SUJ disc (24 mm in diameter× 6.9 mm in height, lapping treatment) manufactured by Optimol Co. Ltd. under a load of 100 N, at a temperature of 100° C., at a frequency of 50 Hz, and at an amplitude of 0.5 mm to obtain an average value of friction coefficients after 30 minutes and then obtain a ratio relative to the commercially available oil.

(6) Rubber Swellability

Test method: according to ASTM D471, immersed a C-type dumbbell-shaped ACM rubber (T945, manufactured by NOK Corporation) in a sample oil at 150° C. to determine a rate of volume change after 70 hours.

Note that, in Comparative Example 2 of Table 4, a commercially available lubricating oil composition for transmission was evaluated.

TABLE 3

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| [C2]/[C1] | 4.5 | 4.5 | 4.5 | 4.5 | 4.5 | 4.5 | 4.5 | 4.5 | 4.5 | 4.5 | 4.5 |
| Viscosity (KV100) of lubricating oil composition | 5.5 | 5.5 | 5.5 | 5.2 | 5.5 | 5.5 | 5.5 | 5.5 | 5.5 | 4.5 | 5.5 |
| VI | 163 | 168 | 170 | 168 | 163 | 163 | 163 | 170 | 168 | 151 | 163 |
| Shear stability | 4 | 4 | 4 | 4 | 4 | 4 | 4 | 4 | 4 | 4 | 4 |
| Anti-shudder life | 450 | 450 | 450 | 450 | 450 | 450 | 450 | 450 | 450 | 450 | 450 |
| Friction coefficient | 1.0 | 1.0 | 1.0 | 1.0 | 1.0 | 1.0 | 1.0 | 1.0 | 1.0 | 1.0 | 1.0 |
| Rubber swellability | 5 | 5 | 5 | 5 | 5 | 5 | 5 | 5 | 5 | 5 | 1 |

TABLE 4

| | Comp. Ex. 1 | Comp. Ex. 2 |
|---|---|---|
| [C2]/[C1] | 0 | — |
| Viscosity (KV100) of lubricating oil composition | 5.2 | 7.2 |
| VI | 161 | 201 |
| Shear stability | 4 | 21 |
| Anti-shudder life | 20 | 200 |
| Friction coefficient | 1.0 | 1.0 |
| Rubber swellability | 5 | 6 |

As indicated in Examples 1 to 11 described in Tables 3 and 4, the lubricating oil compositions of the present disclosure may prolong anti-shudder life without lowering metal-to-metal friction coefficient, although having low kinematic viscosities at 100° C. Additionally, as can be seen from a comparison between Examples 1 to 11 and Comparative Example 1, additionally specifying the structure of component (A) and the structure of component (B) enables provision of lubricating oil compositions having higher shear stability in addition to the above advantageous effect. Furthermore, a comparison between Examples 1 to 10 and Example 11 indicates that specifying the structure of component (A) and including (E) ether sulfolane can further improve swellability of sealing rubber in addition to the above effect.

INDUSTRIAL APPLICABILITY

The lubricating oil composition of the present disclosure may be particularly suitable to use for automobile transmissions, particularly for continuously variable transmissions.

The invention claimed is:

1. A lubricating oil composition, comprising:

(A) a lubricating base oil; and (C) (C-1) a boronated succinimide compound having a weight-average molecular weight of 600 to 7,000;

(C-2) a boronated succinimide compound having a weight-average molecular weight of more than 7,000 and not more than 10,000; and (C-3) a non-boronated succinimide compound.

2. The lubricating oil composition according to claim 1, wherein part or all of component (A) comprises a poly(α-olefin) or α-olefin copolymer having a kinematic viscosity at 100° C. of 6 to 80 $mm^2/s$ in an amount of 5 to 30% by weight based on a total weight of the lubricating oil composition; and wherein the lubricating oil composition further comprises (B) a polymethacrylate having a weight-average molecular weight of 15,000 to 40,000.

3. The lubricating oil composition according to claim 1, wherein each of component (C-1) and component (C-2) contains 0.1 to 3% by weight of boron based on a weight of component (C-1) or component (C-2).

4. The lubricating oil composition according to claim 1, wherein a weight ratio of component (C-2) to component (C-1), i.e., (C-2)/(C-1) is 1 to 10.

5. The lubricating oil composition according to claim 1, wherein the lubricating oil composition has a kinematic viscosity at 100° C. of 3 to 10 $mm^2/s$.

6. The lubricating oil composition according to claim 1, wherein the lubricating oil composition has a viscosity index of 150 or more.

7. The lubricating oil composition according to claim 1, further comprising (D) a metal detergent.

8. The lubricating oil composition according to claim 1, further comprising (E) an ether sulfolane compound.

9. The lubricating oil composition according to 2, wherein each of component (C-1) and component (C-2) contains 0.1 to 3% by weight of boron based on a weight of component (C-1) or component (C-2).

10. The lubricating oil composition according to claim 2, wherein a weight ratio of component (C-2) to component (C-1), i.e., (C-2)/(C-1) is 1 to 10.

11. The lubricating oil composition according to claim 3, wherein a weight ratio of component (C-2) to component (C-1), i.e., (C-2)/(C-1) is 1 to 10.

12. The lubricating oil composition according to claim 2, wherein the lubricating oil composition has a kinematic viscosity at 100° C. of 3 to 10 $mm^2/s$.

* * * * *